US010246808B2

(12) United States Patent
Bae et al.

(10) Patent No.: US 10,246,808 B2
(45) Date of Patent: Apr. 2, 2019

(54) LAUNDRY TREATING MACHINE WITH HIGH FREQUENCY DRYING APPARATUS

(71) Applicant: LG ELECTRONICS INC., Seoul (KR)

(72) Inventors: Sang Hun Bae, Seoul (KR); Tae Hee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 408 days.

(21) Appl. No.: 14/655,960

(22) PCT Filed: Dec. 29, 2012

(86) PCT No.: PCT/KR2012/011823

§ 371 (c)(1),
(2) Date: Jun. 26, 2015

(87) PCT Pub. No.: WO2014/104451

PCT Pub. Date: Jul. 3, 2014

(65) Prior Publication Data

US 2015/0337481 A1 Nov. 26, 2015

(51) Int. Cl.
*F26B 3/34* (2006.01)
*D06F 29/00* (2006.01)
(Continued)

(52) U.S. Cl.
CPC ..... *D06F 29/005* (2013.01); *D06F 39/005* (2013.01); *D06F 39/125* (2013.01); *D06F 58/10* (2013.01); *D06F 58/26* (2013.01)

(58) Field of Classification Search
CPC ..... D06F 29/00; D06F 29/005; D06F 21/00; D06F 21/02; D06F 21/06; D06F 25/00;
(Continued)

(56) References Cited

U.S. PATENT DOCUMENTS 4,499,358 A * 2/1985 Scott ..... H05B 6/06 219/773
6,423,955 B1 * 7/2002 Blaker ..... H05B 6/54 219/772
(Continued)

FOREIGN PATENT DOCUMENTS

CN 1912515 2/2007
CN 101135104 3/2008
(Continued)

OTHER PUBLICATIONS

International Search Report dated Sep. 6, 2013 issued in Application No. PCT/KR2012/011823.
(Continued)

*Primary Examiner* — John McCormack
(74) *Attorney, Agent, or Firm* — Ked & Associates, LLP

(57) ABSTRACT

A laundry treatment machine is provided. The laundry treatment machine includes at least one main body, a pedestal, and a high frequency drying apparatus. The at least one main body includes a drum rotatably disposed therein. The pedestal supports the main body and provides a certain drying space for receiving a drying subject. The high frequency drying apparatus includes an anode to which a high frequency is applied and a cathode electrically insulated from the anode to form an oscillation electric field between the anode and the cathode inside the drying space.

10 Claims, 5 Drawing Sheets

(51) Int. Cl.

| | |
|---|---|
| ***D06F 39/12*** | (2006.01) |
| ***D06F 58/10*** | (2006.01) |
| ***D06F 58/26*** | (2006.01) |
| ***D06F 39/00*** | (2006.01) |

(58) Field of Classification Search

CPC ..... D06F 58/10; D06F 58/16; D06F 58/00; D06F 58/20; D06F 58/226; D06F 58/02; D06F 39/125; H05B 6/54; F26B 3/34; F26B 3/343; F26B 3/347; F26B 3/353; F26B 3/32

USPC ..... 219/780; 34/247, 255; 43/108

See application file for complete search history.

(56) References Cited

U.S. PATENT DOCUMENTS

| | | | |
|---|---|---|---|
| 2007/0045307 | A1 | 3/2007 | Tsui et al. |
| 2007/0151120 | A1 | 7/2007 | Tomasi et al. |
| 2008/0053162 | A1 | 3/2008 | Park et al. |
| 2009/0178441 | A1 | 7/2009 | Detrick et al. |
| 2010/0005681 | A1 | 1/2010 | Jo et al. |
| 2010/0115785 | A1 | 5/2010 | Ben-Shmuel et al. |
| 2011/0099835 | A1* | 5/2011 | Kim ..... D06F 39/125 34/132 |
| 2011/0308101 | A1 | 12/2011 | Wisherd et al. |

FOREIGN PATENT DOCUMENTS

| | | |
|---|---|---|
| CN | 101550649 | 10/2009 |
| CN | 101570934 | 11/2009 |
| CN | 102597356 | 7/2012 |
| KR | 20-0385718 | 6/2005 |
| KR | 10-0774206 | 11/2007 |
| KR | 10-2009-0115015 A | 11/2009 |
| KR | 10-2011-0048849 A | 5/2011 |
| KR | 10-2008-0019847 | 1/2013 |

OTHER PUBLICATIONS

Chinese Office Action dated Apr. 6, 2016 issued in Application No. 201280078169.8 (English translation attached).

Korean Office Action dated Jul. 6, 2016 issued in Application No. 10-2015-7020640.

European Search Report dated Aug. 22, 2016 issued in Application No. 12890707.8.

* cited by examiner

LAUNDRY TREATING MACHINE WITH HIGH FREQUENCY DRYING APPARATUS

CROSS-REFERENCE TO RELATED PATENT APPLICATIONS

This application is a U.S. National Stage Application under 35 U.S.C. § 371 of PCT Application No. PCT/KR2012/011823, filed Dec. 29, 2012, whose entire disclosure is hereby incorporated by reference.

TECHNICAL FIELD

The present disclosure relates to a laundry treatment machine with a high frequency drying apparatus.

BACKGROUND ART

In general, examples of laundry treatment machines include washing machines that supply wash water into a drum holding laundry and remove contaminants from laundry and clothes and drying machines that supply hot air or cool air into a drum to dry laundry. Recently, laundry treatment machines that can perform a drying function as well as a washing function are being widely used.

The clothes drying machine is an apparatus that supplies hot air or cool air into a certain space or drum holding wet clothes to dry the wet clothes. Generally, the clothes drying machine includes a heater for generating heat and a blower for delivering the heat generated from the heater to the space holding clothes. The clothes drying machine induces evaporation of water by increasing the temperature of water contained in clothes using heat delivered by heated air. Since heat is transferred from air having a lower specific heat to water having a higher specific heat, the temperature of water does not significantly increase compared to the temperature of heated air, and the drying performance is low compared to the power consumption.

Also, since the air temperature inside the drum must be equal to or greater than 100 degrees Celsius in order for water contained in clothes to reach the evaporative temperature, contact of hot air with clothes may cause denaturalization or damage of cloth.

Furthermore, the drying machine may include an exhaust system for exhausting water evaporated from clothes out of the drying machine. In this case, since the internal temperature of the drum inevitably drops due to continuous exhaust of heated air, the operation time of the heater increases, and thus the power consumption and the drying time increase.

DISCLOSURE OF INVENTION

Technical Problem

Embodiments provide a laundry treatment machine that can dry clothes using a high frequency.

Embodiments also provide a laundry treatment machine including a high frequency drying apparatus in addition to typical washer and dryer.

Embodiments also provide a laundry treatment machine that can minimize damage of cloth caused by drying of clothes.

Embodiments also provide a laundry treatment machine that can reduce power consumption and drying time spent in drying clothes.

Embodiments also provide a laundry treatment machine that further includes a high frequency drying apparatus while minimizing the structural modification of typical washer and dryer.

Solution to Problem

In one embodiment, a laundry treatment machine includes: at least one main body comprising a drum rotatably disposed therein; a pedestal supporting the main body and providing a certain drying space for receiving a drying subject; and a high frequency drying apparatus comprising an anode to which a high frequency is applied and a cathode electrically insulated from the anode to form an oscillation electric field between the anode and the cathode inside the drying space.

The details of one or more embodiments are set forth in the accompanying drawings and the description below. Other features will be apparent from the description and drawings, and from the claims.

Advantageous Effects of Invention

A laundry treatment machine according to an embodiment can reduce the power consumption and the drying time by drying clothes using a high frequency.

Also, a laundry treatment machine according to an embodiment can perform a high frequency drying function while minimizing the structural modification of typical washer and dryer.

Furthermore, a laundry treatment machine according to an embodiment can prevent denaturalization of cloth caused by a high temperature, by performing drying at a relatively low temperature using a high frequency drying apparatus compared to a drying method using hot air.

BEST MODE FOR CARRYING OUT THE INVENTION

Reference will now be made in detail to the embodiments of the present disclosure, examples of which are illustrated in the accompanying drawings.

Figure 1:
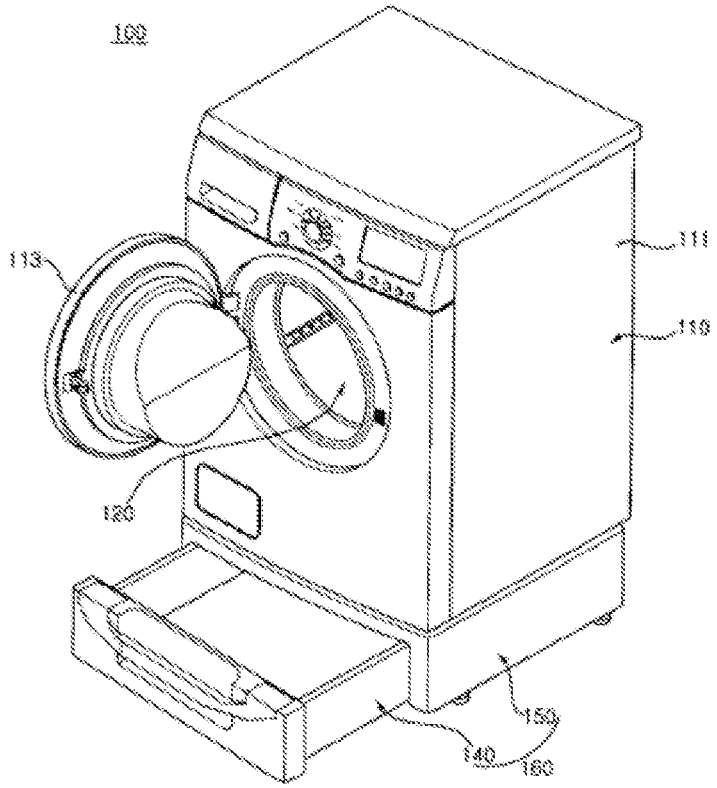
FIG. 1 is a perspective view illustrating a laundry treatment machine according to an embodiment.
Figure 2:
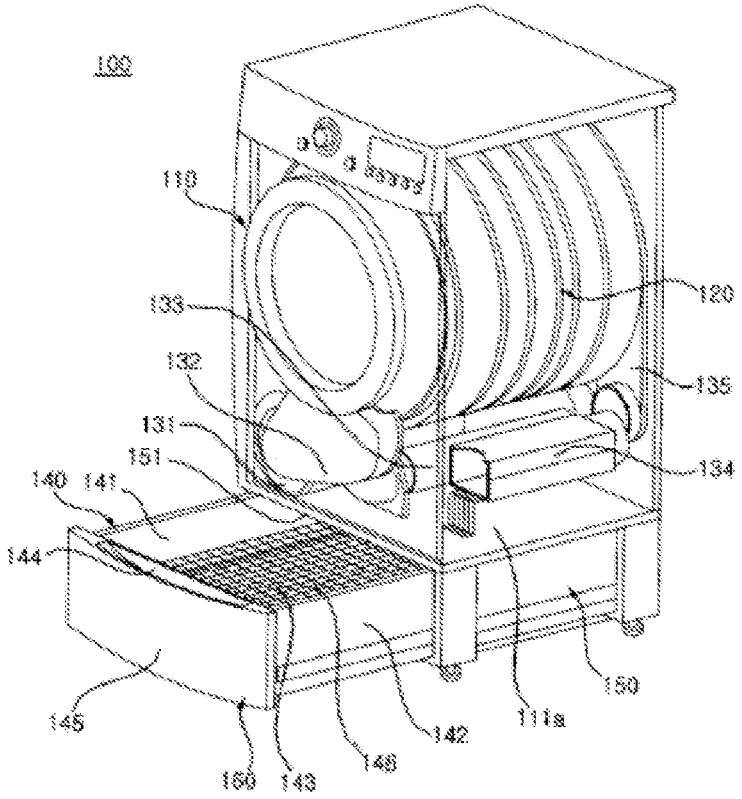
FIG. 2 is a view illustrating an internal configuration of the laundry treatment machine shown in FIG. 1.
Figure 3:
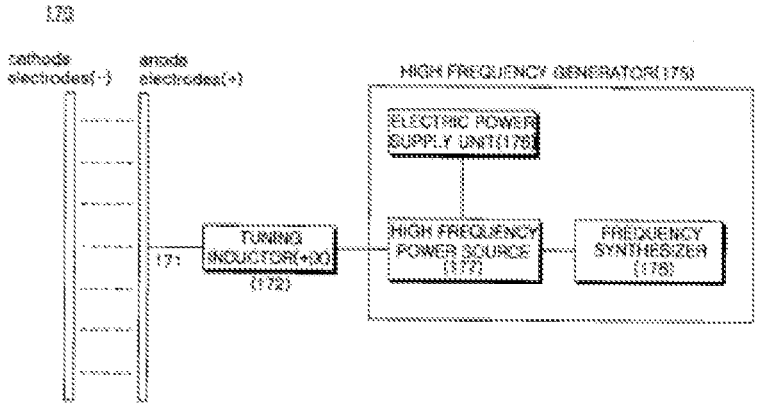
FIG. 3 is a view illustrating a control relation between main components of a high frequency drying apparatus applied to the laundry treatment machine shown in FIG. 1.

FIG. 1 is a perspective view illustrating a laundry treatment machine according to an embodiment. FIG. 2 is a view illustrating an internal configuration of the laundry treatment machine shown in FIG. 1. FIG. 3 is a view illustrating a control relation between main components of a high frequency drying apparatus applied to the laundry treatment machine shown in FIG. 1.

Hereinafter, a drying apparatus will be exemplified to explain a laundry treatment machine according to an embodiment, but the embodiments are not limited thereto. Accordingly, it should be understood that the following description of the embodiments can also be applied or indirected to a washing machine or a washing and drying machine within the technical spirit.

Referring to FIGS. 1 and 3, a dryer 100 may include a main body 110 and a high frequency drying apparatus 170. The main body 110 and the high frequency drying apparatus 170 may independently perform a clothes drying function, respectively. However, the main body 110 may dry clothes using hot air or cool air, whereas the high frequency drying apparatus 170 may dry clothes by forming an oscillation electric field between the anode electrode and the cathode electrode disposed across clothes that are insulating materials.

The main body 110 may include a casing 111 having a laundry loading opening at the front side thereof, a door 113 opening/closing the laundry loading opening, a drum holding a drying subject such as clothes and rotatably disposed inside the casing 111, a heater 134 for heating air, a blower 131 for blowing air heated by the heater 134, a dry duct 135 guiding air blown by the blower 131 into the drum 120, an exhaust duct 133 for exhausting air inside the drum 120 out of the main body 110, and a filter 132 disposed at the inlet of the exhaust duct 133 to filter foreign substances such as lint suspended in the air.

A motor (not shown) may also be disposed to provide a driving force for rotating the drum 120. The power transmission from the motor to the drum 120 may be divided into a direct driving type in which the shaft of the motor is arranged on the same line as the rotation center of the drum 120 and an indirection driving type in which the power transmission is performed using a power transmission member such as gear or belt. Also, the motor may rotate the blower 131 in addition to the drum 120. Although not shown, in this embodiment, the blower 131 is rotated by the motor, and the drum 120 may be rotated by power transmission through a belt wound around the circumferential surface of the drum 120.

The high frequency drying apparatus may dry clothes by applying an electric field oscillating from a high frequency wave or a radio frequency wave to the drum 120. High frequency energy may be used to dry an insulating material such as clothes. When the electric field oscillating from the high frequency wave is applied to clothes, molecules may be excited in the electric field, thereby producing an internal heat gain by friction between molecules. Particularly, when wet clothes absorb sufficient energy, the state of water molecules may be changed from liquid to gas by the heat gain, allowing water to evaporate.

The high frequency drying apparatus 170 may include a high frequency generator for generating a high frequency according to a required frequency and a coaxial cable for transmitting the high frequency from the high frequency generator to anode electrodes. In this case, cathode electrodes may be connected to the ground.

Generally, the high frequency generator may include an oscillator and a triode, and may be referred to as an electron tube. The triode may have an anode, a cathode, and a grid. The oscillator may generate a signal applied to the grid at a desired frequency, and a high voltage between the anode and the cathode may amplify oscillating power to provide a high frequency having high power. The electron tube may be replaced when its life ends. In order to elongate the lifespan of the electron tube, a cooling apparatus may be provided. An air cooling type of cooling apparatus may be commonly used, but a water cooling type of cooling apparatus may be more effective.

Meanwhile, the high frequency generator may supplement the faults of the electron tube, and may be implemented by a solid-state technology. In general, the solid-state technology may be used to generate a radio frequency or high frequency wave in the application fields of the information communication such as mobile communication or wireless network. However, this technology may be suitable for lower power, and it is desirable to further provide an amplifier to acquire high power necessary for drying of clothes. For this, a solid-state transistor may be used. The lifespan of the high frequency generator using the solid-state technology may be significantly extended, and advantageous in terms of repair and replacement compared to the electron tube type.

Referring to FIG. 3, the high frequency drying apparatus 170 may include a high frequency generator 175 for generating a high frequency to form an oscillation electric field between the anode and the cathode that are electrically insulated from each other, a coaxial cable 171 for applying the high frequency generated by the high frequency generator 175 to the anode, and a variable impedance for controlling the intensity of the oscillation electric field formed between the anode and the cathode. The variable impedance may include at least one of induction coil or a condenser. The variable impedance may be a tuning inductor (172).

The high frequency generator 175 may include an electric power supply unit 176 for supplying a DC power and a high frequency power source 177 for receiving electric power from the electric power supply unit 176 and outputting a high frequency power according to the input of a predetermined frequency. The high frequency generator 175 may further include a frequency synthesizer 178. The frequency synthesizer 178 may generate a signal at a predetermined high frequency, and the high frequency power source 177 may output a high frequency power according to the input of the frequency applied from the frequency synthesizer 177.

The high frequency generated by the high frequency generator 175 may be transmitted to the anode (+) through the coaxial cable 11, and may be transmitted via the tuning inductor 172. The reactance may be controlled by the tuning inductor 172, thereby varying the intensity of the electric field between the anode (+) and the cathode (−).

The anode (+) and the cathode (−) may be provided to be insulated from each other. The anode (+) and the cathode (−) may be electrodes only for applying of the electric field, but a portion of the dryer 100 may also be used as electrodes. Particularly, the laundry treatment machine may include a pedestal 160 for supporting the main body 110 in addition to the main body 110 that performs main functions. In this embodiment, the main body 110 may perform a function of drying clothes loaded into the drum 120, and the pedestal 160 may support the main body 110 and may allow the electric field generated by the high frequency drying apparatus 170 to be applied to drying subjects loaded therein. Typically, the pedestal 160 may increase the height of the main body 110 such that a user can easily load/unload laundry to/from the main body 110 without excessively bending at the waist, and may provide an internal storage space to the main body 110 to store detergent, shoes, laundry, and various kinds of household items.

In this embodiment, the high frequency drying apparatus 170 may be implemented in the space provided by the pedestal 160.

The pedestal 160 may include a housing 150 supporting the main body 110 and a storage 140 receiving drying subjects such as clothes and withdrawably disposed in the housing 150. The storage 140 may be slidably disposed along the housing 150. The housing 150 may surround the storage 140, and may have an opening at the front side thereof such that the storage 140 can be inserted/withdrawn.

As described above, the high frequency drying apparatus 170 may include anode electrodes to which a high frequency is applied and cathode electrodes connected to the ground and forming an electric field together with the anode electrodes. In this embodiment, the structure of the pedestal 160 may be utilized to configure the anode electrodes and the cathode electrodes without a separate structure. That is, one of the housing 150 and the storage 140 constituting the pedestal 160 may serve as the anode electrodes, and the other may serve as the cathode electrodes. Both may be insulated from each other such that an electric field can be formed between the housing 150 and the storage 140.

Meanwhile, it may be determined whether a high frequency is applied to the housing 150 or the storage 140. This determination may be performed such that the electric field formed between the housing 150 and the storage 140 is not leaked to the outside. Preferably, the leakage of the electric field out of the storage 140 may be minimized by allowing the housing 150 to serve as the anode and allowing the storage 140 surrounding drying subjects disposed in the housing 150 to serve as the cathode.

Particularly, the storage 140 may be formed to have a box shape that is opened at the upper side thereof to receive drying subjects. A surface 151 of the housing 150 facing a bottom surface 143 of the storage 140 may be determined as the anode to which a high frequency is applied. A side surfaces 141 and 142, the bottom surface 143 and a front surface 144 of the storage 140 may be integrally formed using one metal plate. In this case, the whole internal region of the storage 140 may serve as the cathode. An outer side of the front surface 144 may be provided with an exterior panel 145.

In order to more effectively dry drying subjects inside the storage 140, a method of providing a heat source for increasing the internal temperature of the storage 140 may be considered. For this, a heater may be additionally disposed, but preferably, the electric power supply unit 176, the high frequency power source 177 and/or the tuning inductor 172 that generate heat upon power supply in the high frequency drying apparatus 170 may be disposed adjacent to the pedestal 160. The heat sources may be disposed over a bottom 111*a* of the casing 111 or over the housing 150. Heat generated from the heat sources may be transmitted to the storage 140 by conduction through the housing 150 or the storage 140 or the convection of air by an exhaust system described later.

A supporter 146 may support drying subjects such that the drying subjects can be spaced from the bottom surface 143 of the storage 140. The supporter 146 may have a frame or lattice structure such that an electric field can be easily formed between the housing 150 and the storage 140. Particularly, the supporter 146 may be formed of a material without an electromagnetic interference.

Figure 6:
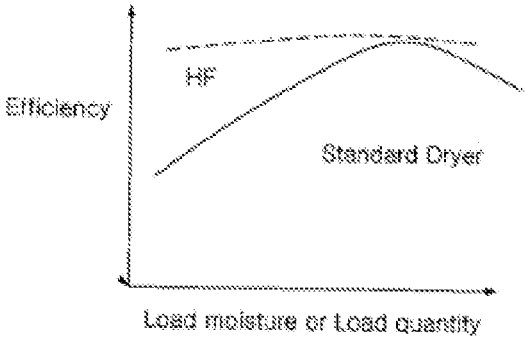
FIG. 6 is a graph illustrating a drying efficiency according to a laundry load upon drying using a high frequency drying apparatus.

As shown in FIG. 6, the drying using the high frequency may be excellent in drying efficiency compared to a typical drying method, i.e., a method of supplying air heated by the heater 134 into the drum 120, which is performed in the main body 110. Since the typical hot air drying method spends most energy in increasing the temperature inside the drum 120 at the initial stage of drying, sufficient drying performance may not be exerted at the initial stage of drying, and excessive energy may be spent compared to the amount of water evaporated from drying subjects at the late stage of drying. Accordingly, the hot air drying method may be low in its efficiency. However, the drying method of using a high frequency may maintain high drying efficiency over the whole drying process. Since water molecules are directly excited by an electric field in the high frequency drying method, the water may be quickly evaporated.

The high frequency drying method may be less dependent on the load quantity compared to the typical hot air drying method. Since the high frequency drying method substantially excites water molecules contained in load by applying an electric field, the drying performance can be uniformly maintained even when the load quantity is changed.

Also, the high frequency drying apparatus 170 can dry subjects even when the temperature inside the drum 120 is below 30 degrees Celsius. This is very low temperature compared to a typical hot air drying method in which drying is performed at a temperature of about 100 degrees Celsius. Accordingly, clothes can be fundamentally prevented from being denaturalized by high temperature.

Figure 4:
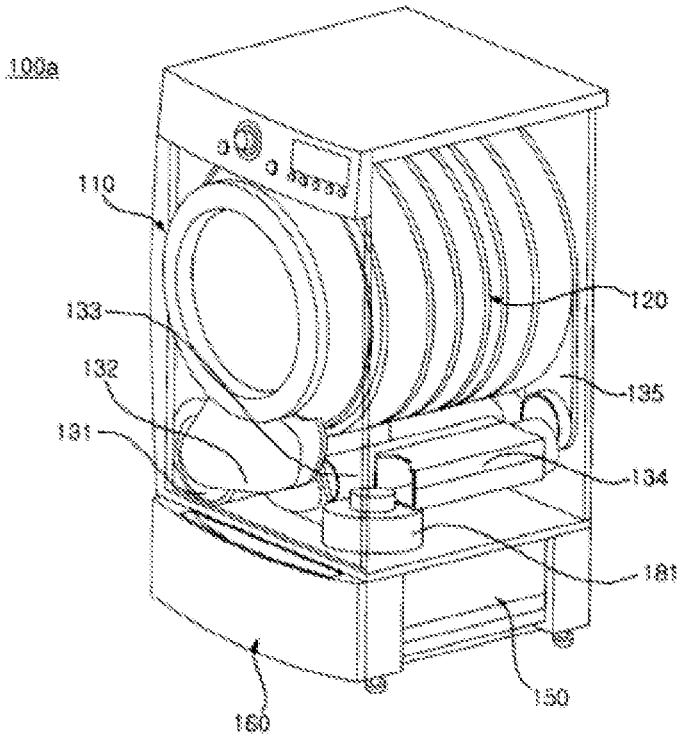
FIG. 4 is a view illustrating an exhaust system of a laundry treatment machine according to an embodiment.

FIG. 4 is a view illustrating an exhaust system of a laundry treatment machine according to an embodiment. Referring to FIG. 4, a dryer 100*a* according to an embodiment may include an exhaust fan 181 for exhausting air inside a pedestal 160 to the outside.

The exhaust fan 181 may be disposed in a casing 111 of a main body 110. The housing 150 constituting the pedestal 160 may have an outlet (not shown) at one side thereof so as to exhaust air inside the pedestal 160 by the exhaust fan 181. Air exhausted from the pedestal 160 by the exhaust fan 181 may be directly exhausted to the main body 110, but may be exhausted out of the dryer 110*a* via an exhaust duct 133 connected to the exhaust fan 181 or a separate exhaust passage.

According to the high frequency drying apparatus 170, air inside the pedestal 160 may increase in its humidity due to water evaporated from drying subjects, but the drying performance may be improved because the exhaust fan 181 operates.

Figure 5:
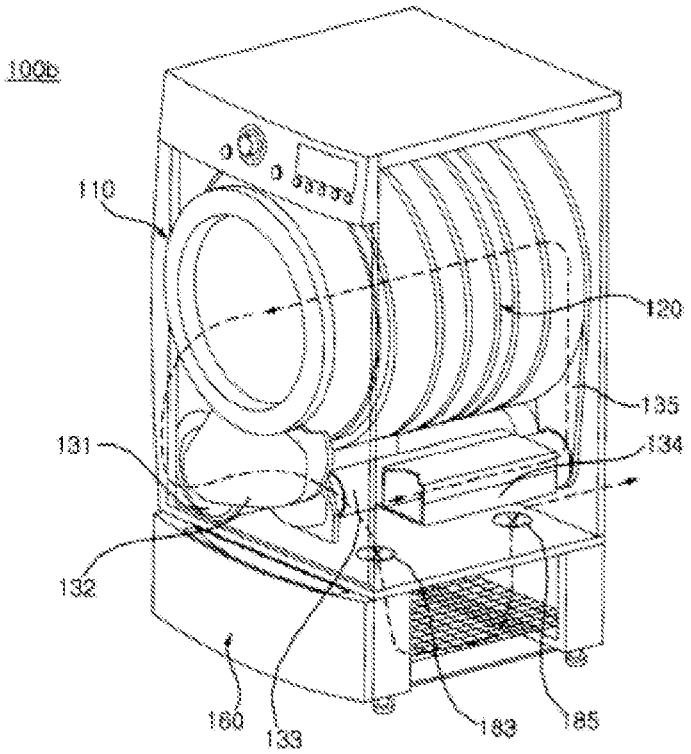
FIG. 5 is a view illustrating an exhaust system of a laundry treatment machine according to another embodiment.

FIG. 5 is a view illustrating an exhaust system of a laundry treatment machine according to another embodiment. Referring to FIG. 5, a pedestal 160 may have an inlet receiving air from the outside and an outlet for exhausting air inside the pedestal 160 to the outside. The inlet and the outlet may be provided with a first valve 183 and a second valve 185 to control the air flow.

Particularly, in this embodiment, a laundry treatment machine having a drying function through a main body 110 may have a structure in which hot air or cool air is supplied into a drum 120 disposed in the main body 110. Particularly, in case of an exhaust type of dryer, air heated by a heater 134 may be delivered to the drum 120 along a dry duct 135 by a blower 131 and then may be applied to drying subjects inside the drum 120. Thereafter, air may be exhausted out of the dryer via an exhaust duct 133.

In this embodiment, this air flow in the main body 110 may be induced to a pedestal 160 through a first valve 183 and/or a second valve 185 to facilitate the improvement of the drying performance upon operation of a high frequency drying apparatus 170. In this case, hot air or cool air may be supplied into the pedestal 160 according to whether or not the heater 134 operates.

The first valve 183 and the second valve 185 may be disposed in a passage bypassing the exhaust duct 133. In this case, the first valve 183 and the second valve 185 may be a 3-way valve. In this structure, air delivered by the blower 131 may not be exhausted out of the dryer 100*b* through the exhaust duct 133, but may be supplied into the pedestal 160 through the inlet opened by the first valve 183 and then exhausted out of the dryer 100*b* along the exhaust duct 133 through the outlet opened by the second valve 185.

Figure 7:
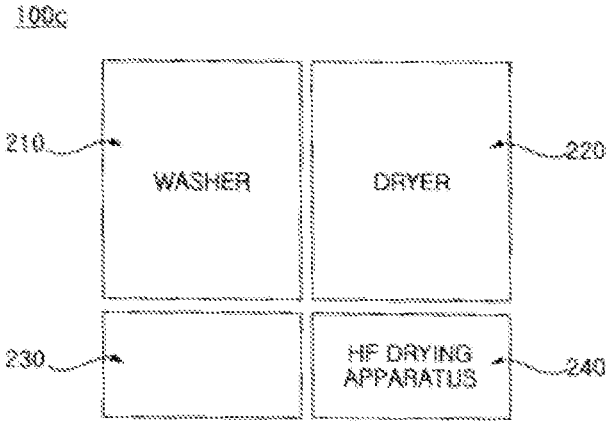
FIG. 7 is a view illustrating a laundry treatment machine according to another embodiment.

FIG. 7 is a view illustrating a laundry treatment machine according to another embodiment. Referring to FIG. 7, a laundry treatment machine 100*c* may include a first main body 210 providing a washing function and a second main body 220 providing a drying function. The first main body 210 may be a washer that supplies wash water into a drum holding laundry and rotating to remove contaminants from laundry, and the second main body 220 may be a dryer that supplies hot air or cool air into a drum holding laundry and rotating to dry laundry. A user may perform washing using the washer 210, and then may load washed laundry into the dryer 220 to dry laundry.

The laundry treatment machine 100*c* may include a first pedestal 230 supporting the washer 210 and a second pedestal 240 supporting the dryer 220. A high frequency drying apparatus 170 may be implemented by utilizing at least one of the first pedestal 230 and the second pedestal 240 as a reception space for drying subjects. For example, as shown in FIG. 7, when the second pedestal 240 is used, an electric field formed between the anode and the cathode of the high frequency drying apparatus 170 may excite water molecules contained in drying subjects inside the second pedestal 240 to dry the drying subjects. Similarly to the previous embodiment, the anode and the cathode may be implemented with a housing 150 and a storage 140 constituting the pedestal.

Figure 8:
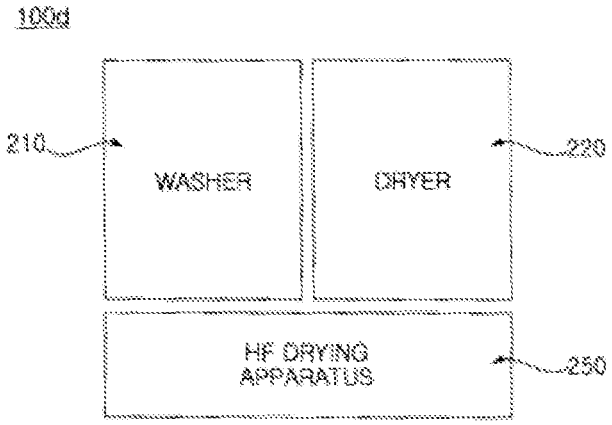
FIG. 8 is a view illustrating a laundry treatment machine according to still another embodiment.

FIG. 8 is a view illustrating a laundry treatment machine according to still another embodiment. Referring to FIG. 8, similarly to FIG. 7, a laundry treatment machine 100*d* may include a first main body 210 serving as a washer and a second main body 220 serving as a dryer, but the first main body 210 and the second main body 220 may be supported a common pedestal 250.

Similarly to the previous embodiments, an electric field formed between the anode and the cathode may excite water molecules contained in drying subjects inside the pedestal 250 to dry the drying subjects. Similarly to the previous embodiments, the anode and the cathode may be implemented with a housing 150 and a storage 140 constituting the pedestal 250.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A laundry treatment machine comprising:

a main body comprising a drum rotatably disposed therein;

a pedestal supporting the main body and providing a certain drying space that receives a drying subject;

a high frequency drying apparatus comprising an anode to which a high frequency is applied and a cathode electrically insulated from the anode to form an oscillation electric field between the anode and the cathode inside the drying space, and a variable impedance configured to control an intensity of the oscillation electric field formed between the anode and the cathode, the variable impedance provided adjacent to the pedestal such that heat generated upon application of an electric current is transmitted into the pedestal, wherein the pedestal comprises:

a storage having an open upper surface such that the drying subject is received into the storage through the open upper surface; and a housing configured to receive the storage therein in a withdrawable manner, wherein the anode is formed on a surface of the housing arranged over the upper surface of the storage and facing a bottom surface of the storage, wherein the storage serves as the cathode, and wherein the variable impedance is provided over a bottom of the main body and heat generated from the impedance is transmitted to the storage by conduction through the housing.

2. The laundry treatment machine of claim 1, wherein the cathode is electrically connected to a ground.

3. The laundry treatment machine of claim 1, wherein the variable impedance comprises at least one of an induction coil or a condenser.

4. The laundry treatment machine of claim 1, further comprising a blower to exhaust air inside the pedestal.

5. The laundry treatment machine of claim 1, further comprising an exhaust duct to exhaust air inside the main body to the outside, wherein a first valve is provided at an upstream side of the exhaust duct to control air flowing into the pedestal along the exhaust duct, and a second valve is provided at a downstream side of the exhaust duct to control air exhausted from the pedestal to the exhaust duct.

6. The laundry treatment machine of claim 5, wherein at least one of the first valve and the second valve is a three-way valve.

7. The laundry treatment machine of claim 5, further comprising a blower that blows air inside the main body to the exhaust duct.

8. The laundry treatment machine of claim 1, wherein: the main body comprises:

a first main body in which wash water is supplied into the drum; and a second main body in which hot air is supplied into a second drum, the second main body being arranged side by side with the first main body, and wherein the pedestal comprises:

a first pedestal supporting the first main body; and a second pedestal supporting the second main body, wherein the high frequency drying apparatus forms an electric field inside at least one of the first pedestal and the second pedestal.

9. The laundry treatment machine of claim 1, wherein the main body comprises:

a first main body in which wash water is supplied to the drum; and a second main body in which hot air is supplied to a second drum, the second main body being arranged side by side with the first main body, wherein the pedestal supports the first main body and the second main body.

10. The laundry treatment machine of claim 1, wherein an internal temperature of the pedestal is less than than 30 degrees Celsius when the electric field is formed inside the pedestal.

* * * * *